United States Patent [19]

Miyake et al.

[11] Patent Number: 4,458,849

[45] Date of Patent: Jul. 10, 1984

[54] SAFETY DEVICE FOR A WINDING APPARATUS

[75] Inventors: Yuzuru Miyake; Takami Sugioka; Shoichi Murakami; Hideaki Ibuki, all of Matsuyama, Japan

[73] Assignee: Teijin Seiki Co. Ltd., Matsuyama, Japan

[21] Appl. No.: 445,720

[22] Filed: Nov. 30, 1982

[30] Foreign Application Priority Data

Dec. 14, 1981 [JP] Japan ..... 56-184889[U]

[51] Int. Cl.[3] ..... B65H 63/00; B65H 63/04

[52] U.S. Cl. ..... 242/36; 242/18 R

[58] Field of Search ..... 242/36, 18 R, 45, 18 CS

[56] References Cited

U.S. PATENT DOCUMENTS 4,307,845 12/1981 Barathieu ..... 242/18 R 4,394,986 7/1983 Hasegawa et al. ..... 242/18 R

FOREIGN PATENT DOCUMENTS 48145 4/1980 Japan ..... 242/36

*Primary Examiner*—Stanley N. Gilreath

*Attorney, Agent, or Firm*—Burgess, Ryan and Wayne

[57] ABSTRACT

A safety device of a spindle drive type winding apparatus wherein the rotational speed of a spindle on which a yarn package is formed is controlled in accordance with a peripheral speed of a yarn package formed on the spindle or tension in yarn to be wound to form a yarn package in such a manner that the rotational speed is gradually decreased during a normal winding operation. The device comprises:

a member for detecting the driving rotational speed of the spindle;

a minimum value holding member for holding the minimum value of the driving rotational speed of the spindle from the start of the normal winding operation to the time just before the measurement of the rotational speed by means of the detecting member; and a member for comparing the rotational speed detected by the detecting member with the minimum value held in the minimum value holding member and for emitting a stop signal to the winding apparatus when the rotational speed is larger than the minimum value by at least a predetermined allowance.

8 Claims, 5 Drawing Figures

SAFETY DEVICE FOR A WINDING APPARATUS

TECHNICAL FIELD TO WHICH THE PRESENT INVENTION RELATES

The present invention relates to a safety device for preventing speeding up of a motor for driving a spindle of a spindle drive type winding apparatus.

PRIOR ART OF THE INVENTION

In a spindle drive type winding apparatus, as is known from, for example, Japanese Patent Publication No. 24983/73, a winding method is generally applied wherein peripheral speed of a yarn package, i.e., winding speed, is detected by contacting a touch roller with a yarn package formed on a spindle, and the rotational speed of the spindle is controlled by feeding back the detected winding speed so that the winding speed may be made to coincide with a predetermined value. If the touch roller disengages from a yarn package, or if the detector for detecting the rotational speed of the touch roller does not correctly operate, a normal feedback signal cannot be obtained from the touch roller. As a result, the motor for driving the spindle is sped up. Consequently, there causes a hazard that the yarn package is ruptured or that the spindle is damaged.

A similar hazard will also occur in a spindle drive type winding apparatus wherein tension in yarn to be wound is controlled at a predetermined value, if a sensor for detecting the tension does not work well.

In order to overcome such hazards, the following methods have been proposed.

(a) A method wherein an abnormal current flowing into the motor is detected.

(b) A method wherein upper limit values slightly higher than the predetermined rotational speed changing pattern are previously programmed in accordance with the change of the rotational speed of the spindle while it is winding a yarn.

However, since electric current flowing into the motor becomes unstable when the tension in yarn being wound changes, or when mechanical resistance changes as time elapses, the method (a) described above often causes a mistake.

Contrary to this, when the method (b) is practiced, programming of the winding pattern is necessary whenever the winding conditions, such as thickness in yarn, winding speed, tension in yarn, are changed. Accordingly, the setting operation for practicing the method (b) is troublesome.

BRIEF DESCRIPTION OF THE INVENTION

The present invention is developed in order to eliminate the above-described problems inherent to the conventional technique, and the present invention relates to a simple safety device for a winding apparatus which can completely prevent the speeding up of a motor from occurrence.

The present invention is based on the fact that in a spindle drive type winding apparatus, the rotational speed of the spindle is necessarily reduced during normal winding operation as the yarn package is formed.

SUMMARY OF THE INVENTION

According to the present invention, a safety device is provided. The device is intended for use in a spindle drive type winding apparatus wherein the rotational speed of a spindle on which a yarn package is formed is controlled in accordance with the peripheral speed of a yarn package formed on the spindle or the tension in yarn to be wound to form a yarn package in such a manner that the rotational speed is gradually decreased during a normal winding operation. The device is characterized by:

a member for detecting the driving rotational speed of the spindle;

a minimum value holding member for holding the minimum value of the driving rotational speed of the spindle from the start of the normal winding operation to the time just before the measurement of the rotational speed by means of the detecting member; and a member for comparing the rotational speed detected by the detecting member with the minimum value held in the minimum value holding member and for emitting a stop signal to the winding apparatus when the rotational speed is larger than the minimum value by at least a predetermined allowance.

BRIEF DESCRIPTION OF THE DRAWINGS

The present invention will now be explained with reference to the accompanying drawings, wherein.

DETAILED DESCRIPTION OF THE INVENTION

Figure 1:
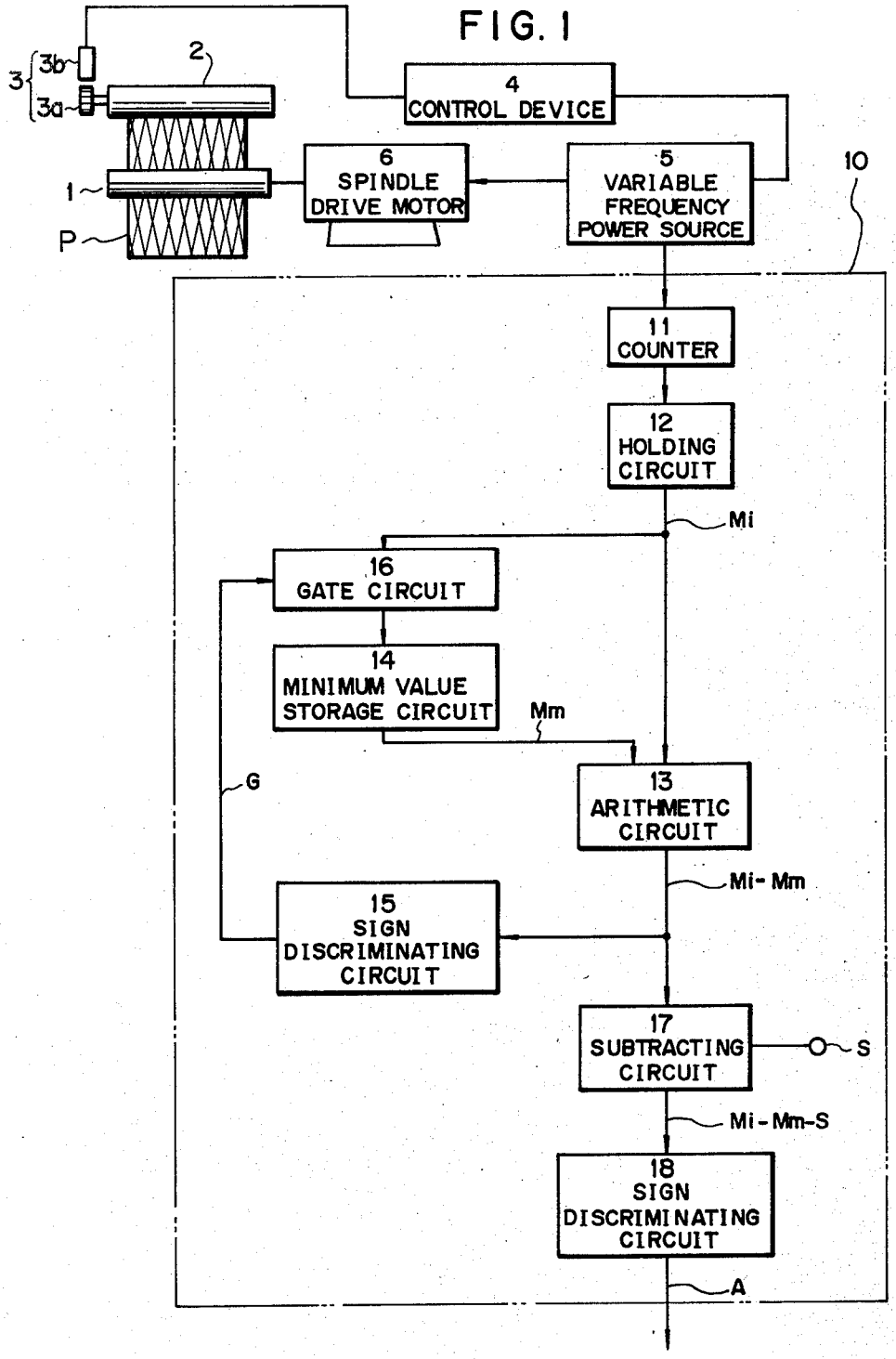
FIG. 1 is a block diagram of an embodiment of the present invention applied to a spindle type yarn winding apparatus wherein the peripheral speed of a wound yarn package is controlled by detecting the speed by means of a touch roller.

Referring to FIG. 1, the safety device of the winding apparatus in the first embodiment of the present invention is controlled by digital circuits. A spindle 1 is rotated by a spindle drive motor 6. A touch roller 2 rotates in contact with the spindle 1 or a yarn package P formed on the spindle 1 at a predetermined contact pressure, thus detecting the rotational speed of a touch roller 2 by means of a conventionally known rotating speed detector 3, corresponding to the winding speed of the yarn. The detector 3 comprises a gear 3*a* or an encoder for generating pulses and a pulse pickup 3*b*. The detected rotating speed is fed back to a control device 4, so that the output frequency of a variable frequency power source 5 is adjusted in order to coincide the winding speed with a predetermined winding speed. Accordingly, the rotational speed of a spindle drive motor 6 and the rotational speed of the spindle 1, are controlled, and therefore, a yarn is wound into a yarn package P at the above-described predetermined winding speed. However, sudden acceleration of the spindle may occur and cause yarn breakage in the conventional apparatus when the feedback signal diminishes because, for example, the touch roller 2 disengages from the yarn package P, as described above.

According to the present invention, the above-described speeding up of the spindle drive motor 6 is prevented in a manner described later. The safety device 10 will now be explained in detail.

As illustrated in FIG. 1, the output frequency of the variable frequency power source 5 is detected by means of a detecting means. The detecting means comprises a counter 11 and a register type holding circuit 12. The counter 11 comprises a number of flip-flop circuits, and the above-described output frequency is continuously counted by means of the counter 11. The holding circuit 12 emits trigger pulses at a predetermined time interval to sample and to reset the counter value in the counter 11 at the predetermined time interval. The holding circuit 12 is a register with, for example, 16 bits and the circuit holds the value as the present value Mi.

Then, the present value Mi held in the holding circuit 12 is input into a first arithmetic circuit 13 on the one hand, and the minimum value Mm which has been held in a register type minimum value storage circuit 14 which is a register with, for example, 16 bits is input into the arithmetic circuit 13 on the other hand. The arithmetic circuit 13 is a subtractor of a known type, and the value Mm is subtracted from the value Mi in the arithmetic circuit 13 to obtain a subtracted value (Mi−Mm).

Thereafter, the subtracted value (Mi−Mm) is input into a sign discriminating circuit 15 of a known type. The sign discriminating circuit 15 outputs a gate pulse G, which opens a gate circuit 16, only when the subtracted value (Mi−Mm) is minus. Accordingly, when the subtracted value (Mi−Mm) is minus, i.e., when the present value Mi is smaller than the stored minimum value Mm, the gate circuit 16 opens, and the present value Mi is stored in the minimum value storage circuit 14 as a new minimum value in place of the old minimum value. As a result, the minimum value storage circuit 14 always stores the minimum value from the start of the winding operation to the measurement.

Figure 2:
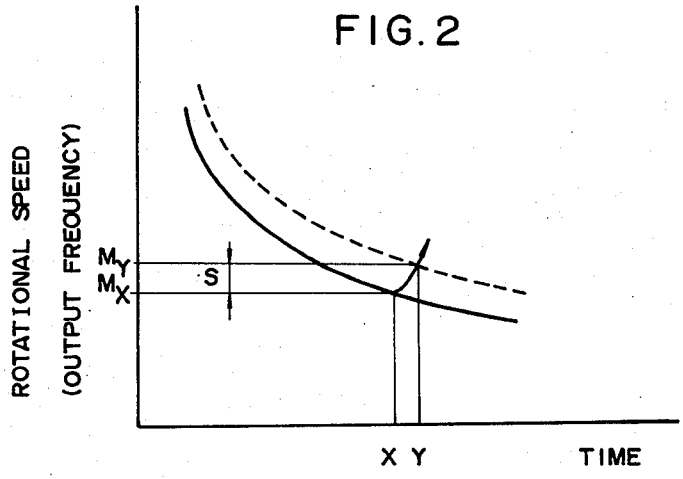
FIG. 2 is a diagram illustrating rotational speeds of a spindle while it is used to wind a yarn and utilized to explain the operation of said embodiment.

Furthermore, the subtracted value (Mi−Mm) output from the arithmetic circuit 13 is input into a second subtracting circuit 17, where a predetermined allowable value S is subtracted from the value (Mi−Mm), and the second subtracting circuit outputs a second subtracted value (Mi−Mm−S). The allowable value S is constant in this embodiment as illustrated in FIG. 2.

Then, the second subtracted value (Mi−Mm−S) is input into another sign discriminating circuit 18. The sign discriminating circuit 18 is so designed that it outputs a stop signal A for stopping the winding apparatus only when the second subtracted value (Mi−Mm−S) is plus, i.e., the present value Mi is larger than the minimum value Mm by at least the allowable value S. Accordingly, the stop signal A is output from the sign discriminating circuit 18 only when the second subtracted value (Mi−Mm−S) is plus. In accordance with this stop signal A, the winding apparatus is stopped.

Since conventionally known circuits can be applied to the above-described circuits, the detailed explanation of the respective circuits is omitted here.

The safety device of the present invention is turned off when the winding apparatus begins its winding operation until the rotating speed of the spindle increases to that of the normal winding operation, in order to enable the smooth starting up of the winding apparatus.

During the normal winding operation wherein the output frequency illustrated in FIG. 2, which is proportional to the rotational speed of the spindle, uniformly decreases as the diameter of a yarn package increases. Accordingly, the measured present values are successively stored in the minimum value storage circuit 14 as the minimum values at the times of measurement. Since the minimum values uniformly decreases, no stop signal A is generated.

Contrary to this, when the output frequency (the rotational speed of the spindle 1) begins to increase as illustrated by a solid line in FIG. 2 due to, for example, the elimination of the above-described feedback signal, the value Mx detected at the time X when the increase begins is stored in the minimum value storage circuit as the minimum value Mm. Then, the minimum value Mm is compared with new present values Mi. At the time Y, the present value Mi becomes larger than the above-described value Mx by at least the allowable value S, which value Mx was detected at the increasing beginning time X and which value Mx has been stored as the minimum value. Then, a stop signal A is output at the time Y, because the value (My−Mx−S) becomes plus. Accordingly, the winding apparatus, at least the motor 6, is stopped. As a result, the speeding up of the motor 6 for driving the spindle 1 does not occur.

According to the present invention, the minimum value Mm is successively and automatically corrected to the present value corresponding to the winding speed as described above. Therefore, it is unnecessary to change the allowable value S in accordance with the change of the types of yarns to be wound, if the value S is set taking safety into consideration.

As explained above, according to the present invention, the speeding up of a yarn winding apparatus can be prevented, and accordingly, the rupture of the spindle 1 or a yarn package formed on the spindle 1 is completely prevented from occurring.

The present invention is not limited to the above-described embodiment. In the above-described embodiment, we have exemplified a device which detects the output frequency of the frequency variable power source, however, other parameters which are equivalent to the driving rotational speed of the spindle can be detected. Accordingly, for example, the rotational speed of a motor for driving a spindle or control signal emitted from a control device can be utilized, and the term "driving rotational speed" must be interpreted to include such embodiments.

Furthermore, we have exemplified in the above-described embodiment a digital circuit comprising the subtracting circuit 13, the sign discriminating circuit 15, the gate circuit 16 and the minimum value storage circuit 14 as a minimum value holding member for holding the minimum value of the spindle driving rotational speed of a spindle from the start of the winding operation to the time wherein the rotational speed is measured. In addition, we have exemplified a digital circuit comprising two arithmetic circuits 13, 17 and a sign discriminating circuit 18 as a stop signal generating member for generating a stop signal A when the measured value of said driving rotational speed is larger than said minimum value by at least a predetermined allowance S. However, analog circuits can also be utilized. In this case, the counter corresponding to that denoted by reference numeral 11 in FIG. 1 includes a wave shaping circuit and an integrating circuit. The wave shaping circuit generates pulses of a predetermined width and amplitude when it receives pulses from the frequency variable power source 5. The integrating circuit has a predetermined time constant, and it integrates the wave shaped pulses from the wave shaping circuit for a time interval equal to the time constant. Thus, a DC signal proportional to the rotational speed of the touch roller 2 is emitted from the counter. Other circuits are also constructed with analog circuits in a manner similar to those described above.

Furthermore, any other circuits are freely applicable. For example, a minimum value holding circuit and a stop signal generating member may be constructed with a microcomputer.

Figure 3:
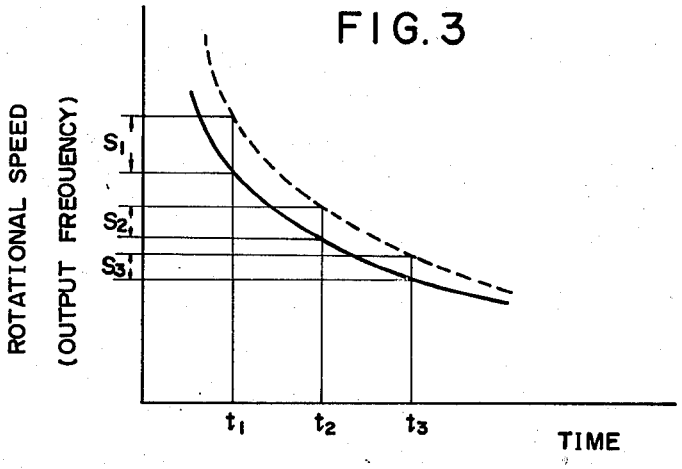
FIG. 3 is another diagram which is a modified form of that illustrated in FIG. 2.
Figure 4:
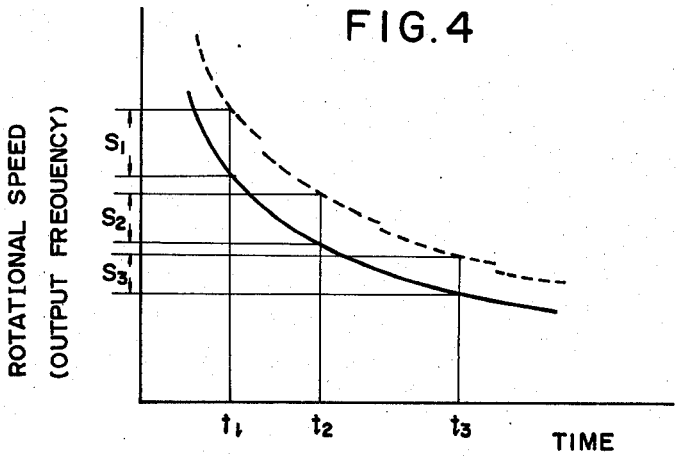
FIG. 4 is a still another diagram similar to FIG. 3.

In the illustrated embodiment, the allowable value S is set constant. However it is possible to set it in such a manner that it is proportional to the rotational speed of the spindle. In such a case, the allowable value continuously decreases and becomes small at the latter part of the winding operation as illustrated in FIG. 3. It is also possible to set the allowable values in such a manner that they change stepwisely as time elapses as illustrated in FIG. 4. Based on the properties of the object to be controlled, the type of the allowable values should be set.

Figure 5:
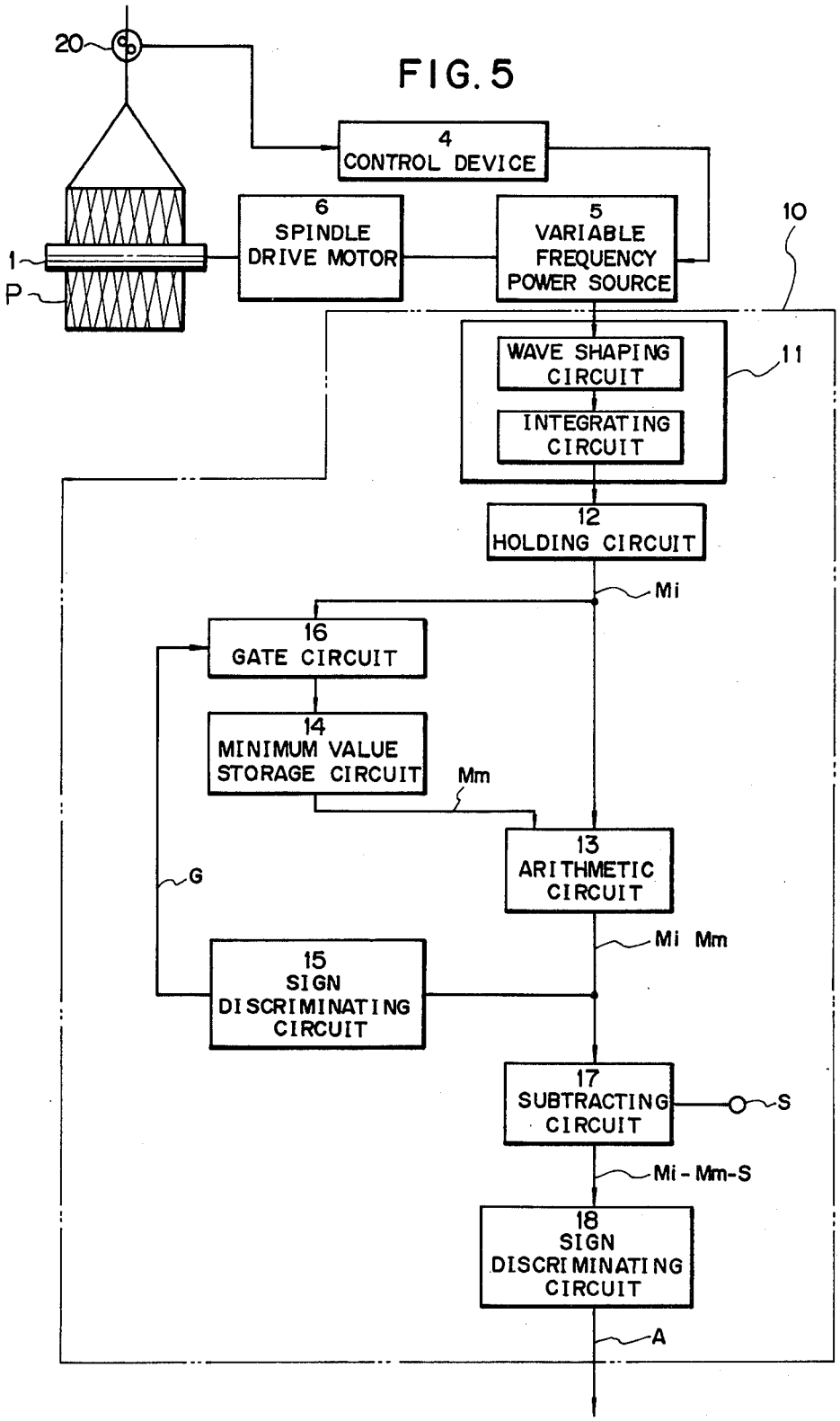
FIG. 5 is a block diagram of another embodiment of the present invention applied to a spindle type yarn winding apparatus wherein tension in wound yarn is controlled by detecting the tension by means of a tension detector.

Further, disclosed is a spindle drive type winding apparatus wherein the peripheral speed is controlled so that the rotating speed of the touch roller coincides with a predetermined value. However, the present invention is also applicable to a spindle drive type winding apparatus wherein tension in yarn to be wound is controlled so that the tension coincides with a predetermined value. Such an embodiment is illustrated in FIG. 5. In FIG. 5, the control is effected by analog circuits, and a detector 20 is disposed to face the yarn passage and detect tension in yarn to be wound into a package in place of the combination of the touch roller 2 and the detector 3 in FIG. 1. Other elements are similar to those illustrated in FIG. 1 except that they are constructed with analog circuits in place of digital circuits, and similar elements are denoted by the same reference numerals, and their further explanation is omitted here.

As explained above, a device of the present invention comprising: a minimum value holding member for holding the minimum value of the spindle driving rotational speed of a spindle from the start of the winding operation to the time wherein the rotational speed is measured; and a stop signal generating member for generating a stop signal when the measured value of said driving rotational speed is larger than said minimum value by at least a predetermined allowance, and accordingly, a safety device, the setting operation of which is very easy and which is always reliable and operates rapidly, is obtained. The present invention is very useful for preventing hazards of a winding apparatus.

We claim:

1. A safety device of a spindle drive type winding apparatus wherein the rotational speed of a spindle on which a yarn package is formed is controlled in accordance with a winding factor in such a manner that the rotational speed is gradually decreased during a normal winding operation, which device is characterized by:

a means for detecting the driving rotational speed of said spindle;

a minimum value holding means for holding a minimum value of said driving rotational speed of said spindle from the start of the normal winding operation to the time just before the measurement of the rotational speed by means of said detecting means; and a means for comparing said rotational speed detected by said detecting means with said minimum value held in said minimum value holding means and for emitting a stop signal to said winding apparatus when said rotational speed is larger than said minimum value by at least a predetermined allowance.

2. A safety device of a spindle drive type winding apparatus according to claim 1, wherein said minimum value holding means includes a means for comparing said minimum value which has been held in said holding means with said driving rotational speed detected by said detecting means and for replacing said minimum value with said detected rotational speed when said rotational speed is smaller than said held minimum value.

3. A safety device of a spindle drive type winding apparatus according to claim 1, wherein said comparing means includes: a circuit for comparing said rotational speed detected by said detecting means with said minimum value held in said minimum vaue holding means; and another circuit for comparing the difference between said rotational speed detected by said detecting means and said minimum value held in said minimum value holding means with said predetermined allowance when said rotational speed is larger than said minimum value; and a circuit for emitting a stop signal to said winding apparatus when said difference is larger than said predetermined allowance.

4. A safety device of a spindle drive type winding apparatus according to claim 1, characterized in that said minimum value holding means includes: a circuit for comparing said minimum value which has been held in said holding means with said driving rotational speed detected by said detecting means; and a circuit for replacing said minimum value with said detected rotational speed when said rotational speed is smaller than said held minimum value, and that said comparing means includes: a circuit for comparing the difference between said rotational speed detected by said detecting means and said minimum value held in said minimum value holding means with said predetermined allowance when said rotational speed is larger than said minimum value; and a circuit for emitting a stop signal to said winding apparatus when said difference is larger than said predetermined allowance.

5. A safety device of a spindle drive type winding apparatus according to claim 1, 2, 3 or 4 characterized in that said winding factor is the peripheral speed of said yarn package, and said winding apparatus includes means for detecting said peripheral speed.

6. A safety device of a spindle drive type winding apparatus according to claim 1, 2, 3 or 4 characterized in that said winding factor is tension in yarn to be wound into said yarn package, and said winding apparatus includes means for detecting said peripheral speed.

7. A safety device of a spindle drive type winding apparatus according to claim 1, wherein said detecting means, said holding means and said comparing means are constituted with digital circuits.

8. A safety device of a spindle drive type winding apparatus according to claim 1, wherein said detecting means, said holding means and said comparing means are constituted with analog circuits.

* * * * *